US010673180B2

(12) United States Patent
Sano

(10) Patent No.: US 10,673,180 B2
(45) Date of Patent: Jun. 2, 2020

(54) ELECTRICAL CONNECTOR

(71) Applicant: Hirose Electric Co., Ltd., Shinagawa-ku, Tokyo (JP)

(72) Inventor: Tomohiro Sano, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/206,954

(22) Filed: Nov. 30, 2018

(65) Prior Publication Data

US 2019/0165515 A1 May 30, 2019

(30) Foreign Application Priority Data

Nov. 30, 2017 (JP) ..... 2017-230742

(51) Int. Cl.

| | |
|---|---|
| ***H01R 13/62*** | (2006.01) |
| ***H01R 13/627*** | (2006.01) |
| ***H01R 13/506*** | (2006.01) |
| *H01R 13/6581* | (2011.01) |

(52) U.S. Cl.

CPC ..... *H01R 13/6278* (2013.01); *H01R 13/506* (2013.01); *H01R 13/6581* (2013.01)

(58) Field of Classification Search

CPC ..... H01R 23/682; H01R 23/7068; H01R 13/518; H01R 23/7005; H01R 25/142

USPC ..... 439/326, 328, 637, 540.1, 64, 94

See application file for complete search history.

(56) References Cited

U.S. PATENT DOCUMENTS

| | | | | |
|---|---|---|---|---|
| 4,767,345 A * | 8/1988 | Gutter | ..... | H01R 13/514 439/497 |
| 9,184,523 B2 * | 11/2015 | Tamai | ..... | H01R 31/06 |
| 9,356,369 B2 * | 5/2016 | Tamai | ..... | H01R 12/7082 |

FOREIGN PATENT DOCUMENTS

JP 2016-152145 A 8/2016

* cited by examiner

*Primary Examiner* — Phuong Chi Thi Nguyen

(74) *Attorney, Agent, or Firm* — Procopio, Cory, Hargreaves & Savitch LLP

(57) ABSTRACT

The coupling members are positioned so as to span both paired housing halves and extend across the multiple connecting units in the direction of coupling of the connecting units, while, at the same time, having pairs of engaging portions engaging the respective housing halves of each connecting unit 10, and each of the paired housing halves has engageable portions engaging the corresponding engaging portions both in the direction of connection to counterpart connector components and in the direction of coupling.

4 Claims, 6 Drawing Sheets

ELECTRICAL CONNECTOR

CROSS REFERENCE TO RELATED APPLICATIONS

This Paris Convention Patent Application claims benefit under 35 U.S.C. § 119 and claims priority to Japanese Patent Application No. JP 2017-230742, filed on Nov. 30, 2017, titled "ELECTRICAL CONNECTOR", the content of which is incorporated herein in its entirety by reference for all purposes.

BACKGROUND

Technical Field

The present invention relates to an electrical connector that has connecting units formed using a pair of housing halves to secure in place blades having a row of terminals, and that is formed by coupling a plurality of such connecting units.

Background Art

In an electrical connector composed of these types of connecting units, the housing, which is formed by joining paired housing halves, has openings in both housing halves in the direction of connection to counterpart connector components, such as counterpart connectors and the like, thereby allowing the counterpart connector components to be received in the respective openings. As a result, the respective counterpart connector components can be placed in contact with the corresponding ends of the terminals.

The housing of the above-mentioned connecting units is shaped to be able to hold the blades. In this configuration, the housing is formed by splitting it into a pair of housing halves in such a manner that when the blades are inserted into one housing half, the protruding sections of said blades are inserted into the other housing half, as a result of which said blades can be secured in place by both housing halves. In such connecting units, as can be seen, for instance, in Patent Document 1, in order to prevent the paired housing halves (the top and bottom holders in Patent Document 1) from being separated, lance-shaped engagement tabs are provided at two locations in the direction of connection on the shielding plates provided on the blades (connecting blades), with one of the engagement tabs in one position engaging one housing half and another engagement tab in the other position engaging the other housing half, thereby securing the blades in place using both housing halves. In FIG. 1 of Patent Document 1, rows of engagement window portions are formed in the top and bottom portions of the front faces of the two housing halves that make up the housing (insulating holder) (top and bottom holder). The engagement tabs provided on the blades inserted into said housing halves enter the above-mentioned engagement window portions and thereby make it possible to engage the housing halves.

An electrical connector is formed by joining a plurality of the above-mentioned connecting units. The multiple connecting units are coupled by coupling members (not shown) having engagement prongs. In Patent Document 1, window portions are formed in each of the multiple connecting units in the lateral faces of the junction section of the two paired housing halves (in the faces perpendicular to the above-mentioned front face). At the same time, inner grooves retaining the coupling members are formed on the inside of the locations of the window portions of the two housing halves. As a result of deforming the engagement prongs of the coupling members retained in said inner grooves by inserting an appropriate tool piece through the above-mentioned window portions, said engagement prongs are engaged with the corresponding portions of the housing and the multiple connecting units are coupled such that there is no separation in the above-mentioned coupling direction.

In this manner, the paired housing halves are held by the blades so that they won't detach from one another, thereby forming a single connecting unit in conjunction with the blades. Multiple connecting units are coupled by the coupling members, thereby forming a single electrical connector.

PRIOR ART DOCUMENTS

Patent Documents

[Patent Document 1] Japanese Patent Application Publication No. 2016-152145

SUMMARY

The present disclosure is directed to an electrical connector that makes it possible to engage paired housing halves and couple multiple connecting units using locations only on the lateral faces of the connecting units, and that simplifies the internal structure of the connector and facilitates the assembly operations thereof.

However, since in the case of the connector of Patent Document 1, a single electrical connector was obtained by integrating the two housing halves so as to form a single connecting unit by engaging and joining them using the engagement tabs of the shielding plates provided on the blades and coupling a plurality of such connecting units using coupling members, obtaining a single connector required two types of joining means, i.e., the engagement tabs of the blades and the coupling members. Furthermore, the engagement tabs of the shielding plates provided on the blades were provided on the front faces of the connecting units and the coupling members were provided at two different locations at the lateral faces of the connecting units, which increased the complexity of the internal structure of the connector and, in addition, made assembly operations more burdensome.

Furthermore, another problem was that the strength of the housing halves was diminished because the housing halves had formed therein numerous engagement window portions arranged in the width direction of the above-mentioned housing halves for engaging the engagement tabs of the shielding plates.

In view of these circumstances, it is an object of the present invention to provide an electrical connector that makes it possible to engage the paired housing halves and couple the multiple connecting units using locations only on the lateral faces of the connecting units, and that simplifies the internal structure of the connector and facilitates the assembly operations thereof.

The electrical connector according to the present invention is an electrical connector adapted such that blades that hold in place arrays of multiple terminals extending in a direction of connection to counterpart connector components are secured in place by a pair of housing halves split in said direction of connection, thereby forming a single connecting unit, each of the respective paired housing halves can be mated with a counterpart connector component in the above-mentioned direction of connection, and multiple connecting units are coupled by coupling members extending in a coupling direction perpendicular to the terminal array plane of the blades.

With such an electrical connector, in the present invention, the coupling members are positioned so as to span both paired housing halves and extend across multiple connecting units in the above-mentioned direction of coupling, while, at the same time, having pairs of engaging portions engaging the respective housing halves of each connecting unit, and each of the paired housing halves has engageable portions engaging the corresponding engaging portions both in the above-mentioned direction of connection and in the direction of coupling.

In the present invention, the engaging portions provided on the coupling members located at the lateral faces of the connecting units are provided in alignment with the paired housing halves for each connecting unit, with said engaging portions engaging the engageable portions of the housing halves both in the direction of connection and in the direction of coupling. Therefore, it becomes possible to form the connecting units and couple the multiple connecting units using the coupling members alone by bringing the above-mentioned coupling members into engagement with the paired housing halves.

In the present invention, the above-mentioned coupling members are metal strip-shaped members and the above-mentioned engaging portions may be formed as engagement tabs obtained by cutting out and raising portions from said coupling members and may be made capable of resilient deformation. In this manner, as a result of using metal strip-shaped members as the coupling members, the above-mentioned engagement tabs (engaging portions) can be formed by simply cutting out and raising portions of said metal strip-shaped members.

In the present invention, the above-mentioned engageable portions have engageable recessed portions allowing for the above-mentioned engagement tabs to be push-fitted therein, and the above-mentioned engagement tabs may be adapted to engage the interior wall surface of the above-mentioned engageable recessed portions of the housing halves with the edges of said engagement tabs. In such a configuration, when the above-mentioned engagement tabs are inserted into the above-mentioned engageable recessed portions, the edges of said engagement tabs engage the interior wall surface of the above-mentioned engageable recessed portions both in the above-mentioned direction of connection as well as in the above-mentioned direction of coupling.

In the present invention, in the above-mentioned housing halves, there are formed insertion grooves that are open to the mutually opposed faces of the paired housing halves forming the above-mentioned connecting units and that permit insertion of the above-mentioned coupling members in the direction of connection up to the central location of said coupling members, and, in the above-mentioned coupling members, the above-mentioned engagement tabs can undergo resilient deformation when said coupling members are inserted into the above-mentioned insertion grooves, and, once a predetermined position is reached, the amount of resilient deformation is reduced and the tabs are push-fitted into the above-mentioned engageable recessed portions of the above-mentioned housing halves.

If such a configuration is used, simply inserting the above-mentioned coupling members into the above-mentioned insertion grooves of each respective housing half in the process of electrical connector assembly makes it possible to push-fit the engagement tabs into the engageable recessed portions and easily bring them into engagement with said engageable recessed portions.

In the present invention, as described above, a single connecting unit is formed by joining the paired housing halves that secure the blades in place, and, in order to form a single electrical connector by coupling a plurality of connecting units, the above-mentioned paired housing halves are joined and the multiple connecting units are coupled using the coupling members alone. For this reason, in contradistinction to the prior-art process of coupling of the connecting units, forming engagement window portions in the housing halves solely for the purpose of joining the two housing halves is not necessary. Accordingly, this improves the strength of the housing halves. Moreover, their internal structure is simplified, the number of man-hours needed for connector assembly is reduced, and connector assembly operations are made easier.

DETAILED DESCRIPTION

Embodiments of the present invention will now be described below with reference to the accompanying drawings.

Figure 1:
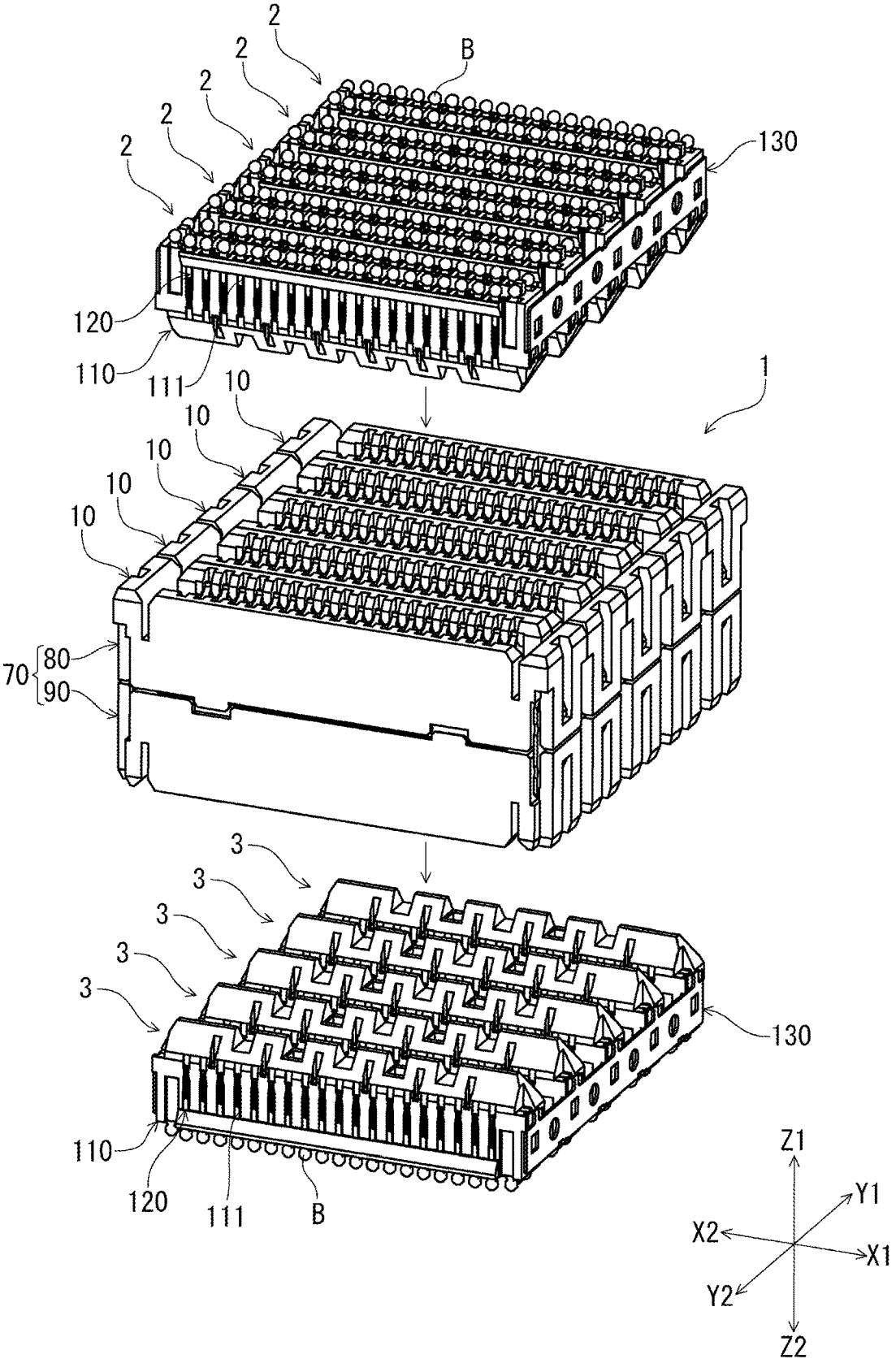
FIG. 1 illustrates a perspective view of an electrical connector according to an embodiment of the present invention and two counterpart connectors connected thereto from above and from below, illustrating a state prior to mating.
Figure 2:
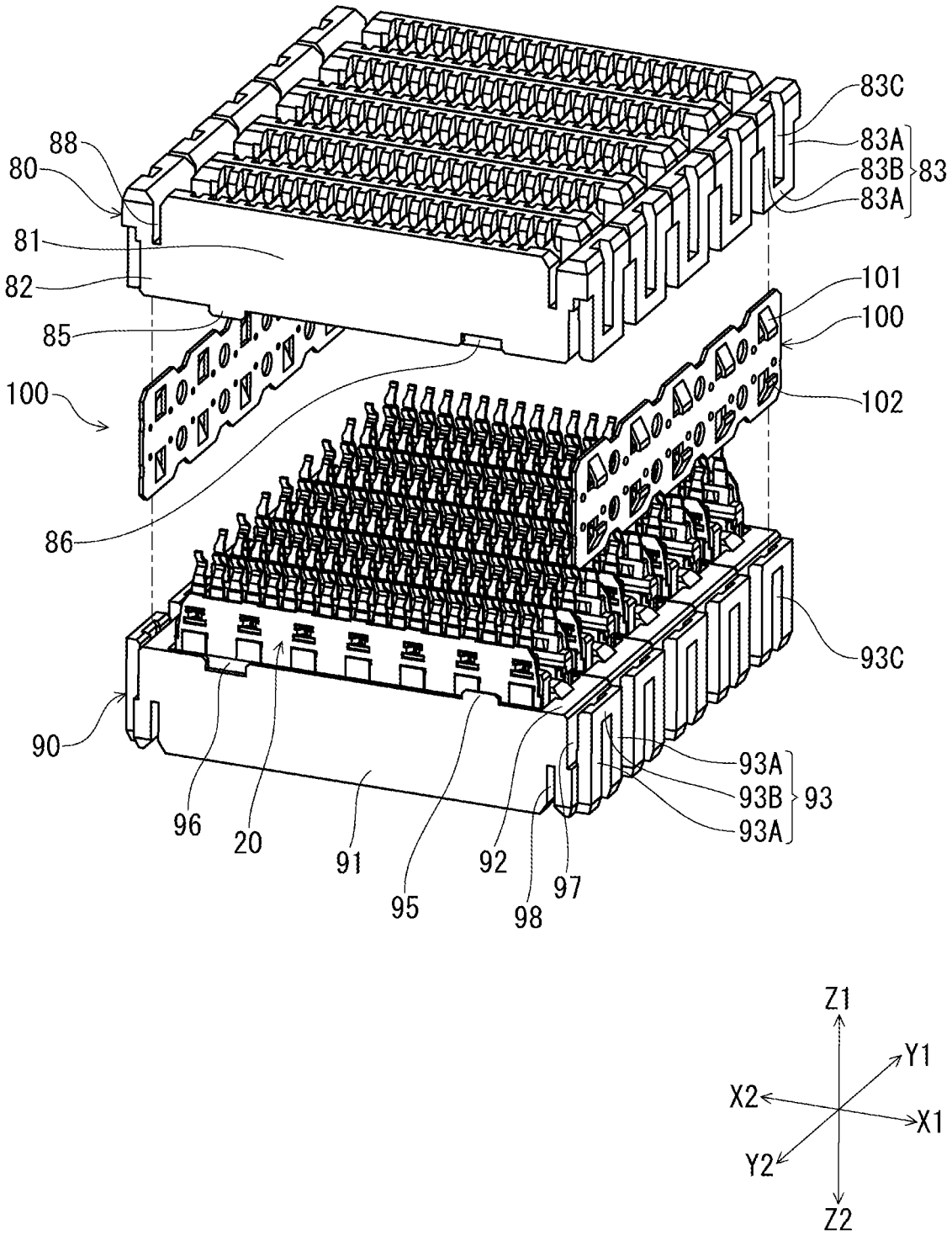
FIG. 2 illustrates a perspective view illustrating the parts of the electrical connector of FIG. 1 in a separated state.

FIG. 1 is a perspective cross-sectional view illustrating an intermediate electrical connector, which is an electrical connector according to an embodiment of the present invention, along with counterpart connectors in a state prior to connector mating. Further, FIG. 2 is a perspective view illustrating the parts of the electrical connector of FIG. 1 in a separated state. In the intermediate electrical connector 1 according to the present embodiment (referred to simply as the "intermediate connector 1" below), the vertical direction (Z-axis direction) is the direction of connection of the connectors. Counterpart connectors 2 and 3, which serve as multiple counterpart connector components, are connected thereto respectively from above (Z2 direction) and from below (Z1 direction), and a trunk connection is established between the two connectors. Said counterpart connectors 2 and 3, which are shaped identically to each other, are electrical connectors for circuit boards respectively connected to different circuit boards (not shown). The present embodiment, as can be seen in FIG. 1, is a configuration in which five counterpart connectors 2 disposed on one circuit board and five counterpart connectors 3 disposed on another circuit board are connected via one intermediate connector 1 having five connecting units 10, as will be described below.

The intermediate connector 1 illustrated in FIG. 1 has multiple connecting units 10, which are connected to the counterpart connectors 2 and 3, and two coupling members 100 made of a sheet of metal, which arrange and collectively couple said multiple connecting units 10 (see FIG. 2). In the present embodiment, there are five connecting units 10 provided in alignment with the respective multiple counterpart connectors 2 and 3. These five connecting units 10 are arranged in a direction parallel to the surface of the circuit boards (Y-axis direction in FIG. 1) and coupled by the coupling members 100 such that the direction of coupling is the same direction.

Two paired blades 20, which are shaped identically to each other and are disposed facing one another so as to be symmetric in the array direction of the connecting units 10 (Y-axis direction), are formed in each connecting unit 10 and are received and secured in place by the hereinafter-described housing 70 (see FIG. 5(C)). Spaces, which are upwardly open in the top portions of the connecting units 10 between the blades 20, are formed as top receiving portions 11 (see FIG. 5(C)) intended to receive the hereinafter-described counterpart connectors 2 from above. On the other hand, spaces, which are downwardly open in the bottom portions of the connecting units 10 between the blades 20, function as bottom receiving portions 12 (see FIG. 5(C)) intended to receive the hereinafter-described counterpart connectors 3 from below.

Figure 3B:
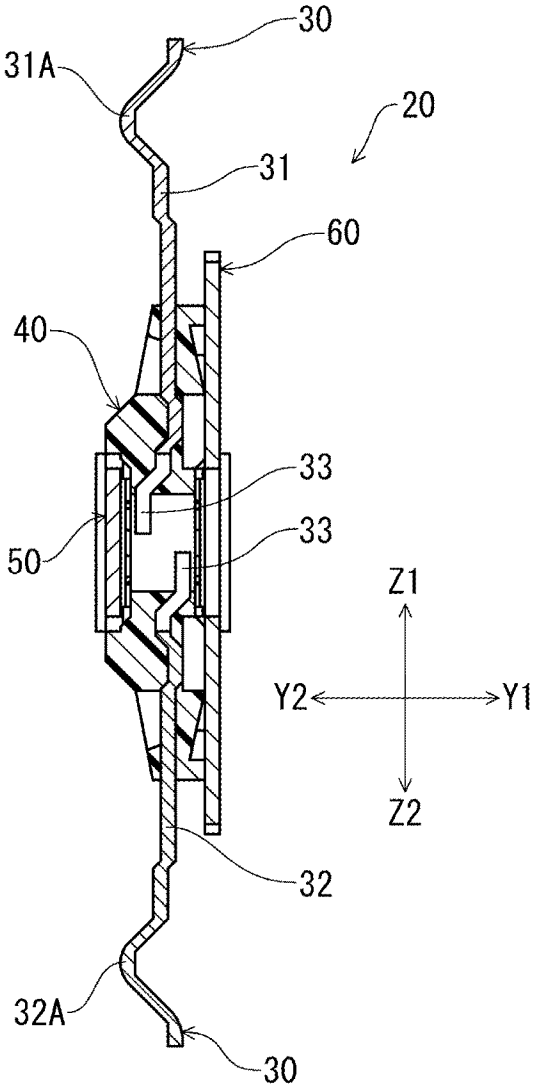
FIG. 3(B) is a cross-sectional view of said blade illustrating a cross section taken in a plane perpendicular to the connector width direction.
Figure 3A:
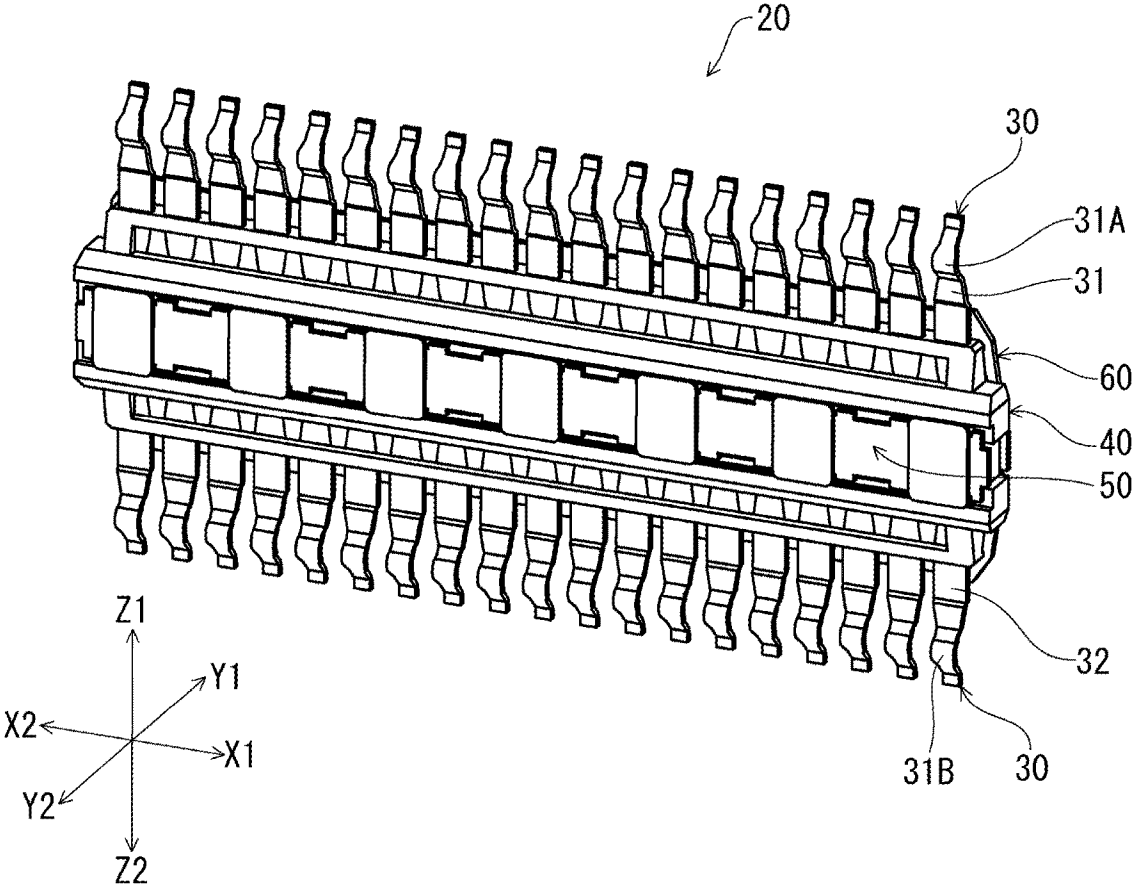
FIG. 3(A) is a perspective view illustrating a single blade of the electrical connector of FIG. 1.

FIG. 3(A) is a perspective view illustrating a single blade 20 of the intermediate connector 1 of FIG. 1, and FIG. 3(B) is a cross-sectional view of the blade 20 in a plane (YZ plane) perpendicular to the connector width direction (X-axis direction) illustrating a cross-section taken at the location of a terminal in the connector width direction. As can be seen in FIG. 3(A), the blade 20 has multiple terminals 30, which are arranged in an array in the connector width direction at equally spaced intervals, a plastic substrate 40, which collectively secures said multiple terminals 30 in place using unitary co-molding, an internal grounding plate 50 attached to one major side of said substrate 40 (Y2 side in FIG. 3(A) and FIG. 3(B), which corresponds to the hereinafter-described "internal side"), and an external grounding plate 60 attached to the other major side (Y1 side in FIG. 3(A) and FIG. 3(B), which corresponds to the hereinafter-described "external side") (see also FIG. 3(B)). Below, in each blade 20 of the two paired blades 20, the mutually opposed faces are referred to as the "internal sides," while the opposite faces are referred to as the "external sides."

As can be seen in FIG. 3(A) and FIG. 3(B), the terminals 30 are made by partly bending strip-shaped metal members extending in the connector mating direction, in other words, in the vertical direction. Said terminals 30 have top resilient arm portions 31, which project upwardly from the upper end of the substrate 40, bottom resilient arm portions 32, which project downwardly from the lower end of said substrate 40, and coupling portions 33, which extend in the vertical direction and couple the top resilient arm portions 31 to said bottom resilient arm portions 32 (see FIG. 3(B)). In the present embodiment, the shapes of the coupling portions 33 of the two adjacent paired terminals 30 are different, with the middle portions of the coupling portions 33 extending in an oblique manner so as to mutually intersect when viewed in the thickness direction of the blade 20 (Y-axis direction). Therefore, the terminals 30, whose top resilient arm portions 31 are shown at the top of FIG. 3(B), and terminals 30, whose bottom resilient arm portions 32 are shown at the bottom of the same drawing, are separate mutually adjacent terminals.

Both the top resilient arm portions 31 and the bottom resilient arm portions 32 are resiliently displaceable in the through-thickness direction. Top contact portions 31A and bottom contact portions 32A, which are bent such that they protrude in the above-mentioned through-thickness direction (Y-axis direction) toward the internal side (Y2 side), are formed on the upper end side of said top resilient arm portions 31 and on the lower end side of said bottom resilient arm portions 32. The top contact portions 31A and bottom contact portions 32A are designed to be in resilient contact with the terminals 120 of the counterpart connectors 2 and 3 (the hereinafter-described "counterpart terminals 120").

As can be seen in FIG. 3(A) and FIG. 3(B), the substrate 40 has a rectangular plate-like configuration which, along with extending across the terminal array range in the connector width direction (X-axis direction), extends across the range of the coupling portions 33 in the vertical direction (Z-axis direction).

As previously discussed, the internal grounding plate 50 is provided such that it is located on the inner lateral face of the substrate 40 (major face on the Y2 side in FIG. 3(A) and FIG. 3 (B)). As previously discussed, the external grounding plate 60 is provided such that it is located on the outer lateral face of the substrate 40 (major face on the Y1 side in FIG. 3(A) and FIG. 3 (B)). The internal grounding plate 50 and external grounding plate 60 are secured in place on the substrate 40 by ultrasonic welding to the respectively corresponding major faces of the substrate 40.

As can be seen in FIG. 1, the housings 70, which are made of an electrically insulating material, have a top housing half 80 and a bottom housing half 90 split in the vertical direction. The top housing half 80 and bottom housing half 90 are shaped identically to each other. In said housings 70, the inner lateral faces of the two blades 20 are arranged in a face-to-face relationship, with the top halves of both blades 20 received and secured in place by the top housing half 80 and the bottom halves of both blades 20 received and secured in place by the bottom housing half 90 (see FIG. 5(C)).

The configuration of the bottom housing half 90 is described below with reference to FIGS. 1 to 6(C). The configuration of the top housing half 80 will not be discussed herein, and the reference numerals of the components thereof may be obtained by subtracting "10" from the reference numerals of the components of the bottom housing half 90 (for example, the "engageable portion" of the top housing half 80, which corresponds to the hereinafter-described "engageable portion 93" of the bottom housing half 90, is assigned the reference numeral "83"). As can be seen in FIG. 2, said bottom housing half 90 has two long walls 91, which extend in the connector width direction (X-axis direction), two short walls 92, which extend in the array direction of the connecting units 10 (Y-axis direction) and couple the ends of the above-mentioned long walls 91, and engageable portions 93, which are coupled to said short walls 92, and is generally of a substantially rectangular parallelepiped-like external configuration. In addition, as can be seen in FIG. 5(A), a partition 94, which extends in the above-mentioned connector width direction between the two long walls 91 and couples the interior wall surfaces of the two short walls 92, is formed at a central location in the above-mentioned array direction of the bottom housing half 90. The two spaces, which are enclosed by these long walls 91, short walls 92, and the partition 94 and form a passage in the vertical direction, form blade-receiving opening portions 99 intended to receive the respective blades 20.

Multiple interengaging portions 95, 96 are provided as parts of the long walls 91 in the connector width direction, at the upper end of each long wall 91 of the bottom housing half 90, in other words, in the section opposed to the top housing half 80. Specifically, a first interengaging portion 95 is provided at one end of the long walls 91 in the connector width direction, and a second interengaging portion 96 is provided at the other end of the long walls 91 in the connector width direction. Furthermore, the first interengaging portion 95 in one long wall 91 and the second interengaging portion 96 in the other long wall 91 are provided at the same location in the connector width direction and, in addition, the second interengaging portion 96 in the other long wall 91 and the first interengaging portion 95 in the other long wall 91 are provided at the same location in the connector width direction. In other words, when the bottom housing half 90 is viewed in the vertical direction, the first interengaging portions 95 and the second interengaging portions 96 are located such that they are point symmetric relative to the center of the bottom housing half 90.

Figures 5A, 5B, 5C:
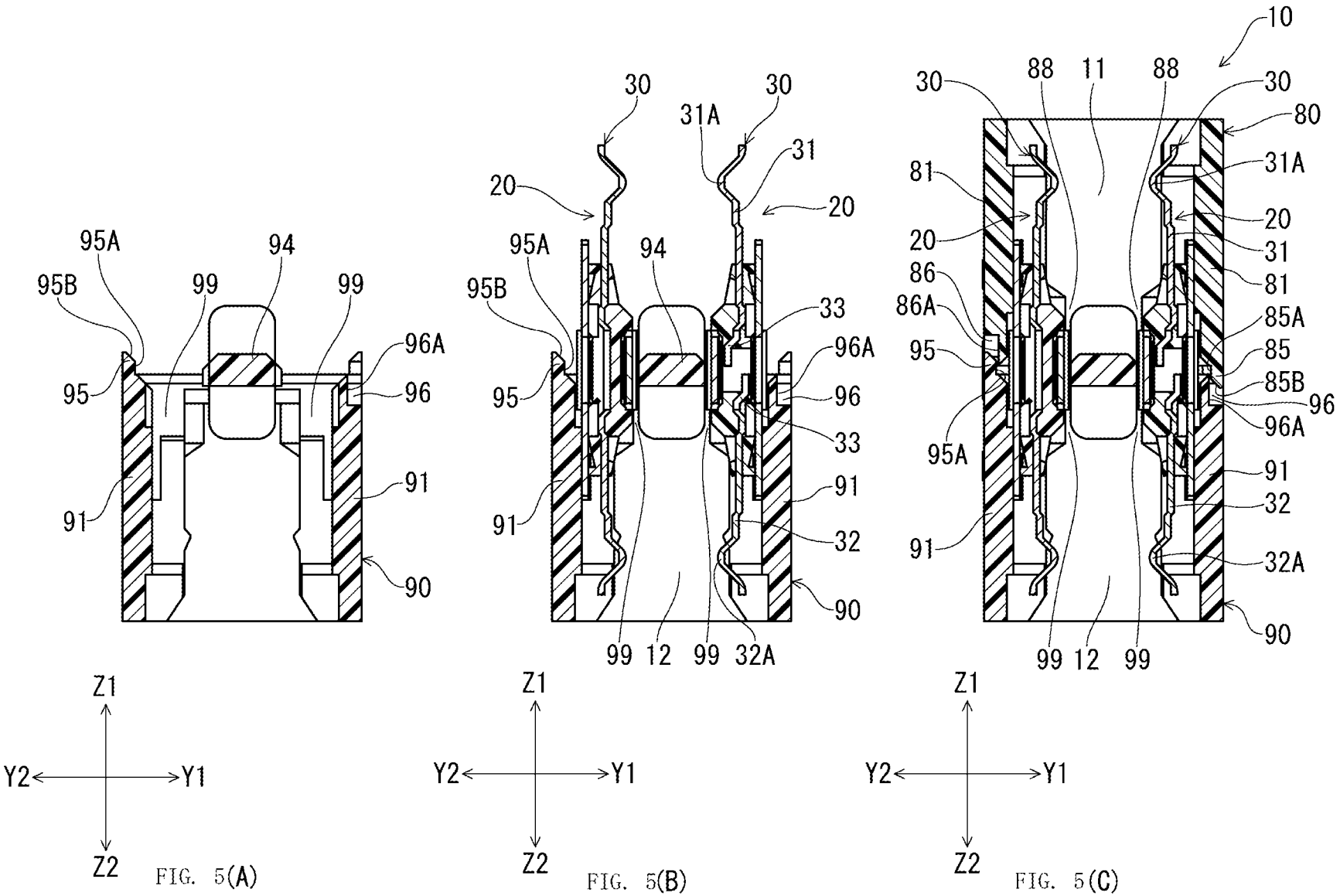
FIG. 5(A) is a cross-sectional view of the bottom housing half alone.
FIG. 5(B) is a cross-sectional view of said bottom housing half and two blades.
FIG. 5(C) is a cross-sectional view of the connecting unit, where each view respectively shows a cross section taken in a plane perpendicular to the connector width direction.

As can be seen in FIG. 5(A), the first interengaging portions 95 are formed as protrusions projecting from the upper faces of said long walls 91 on the external side within the wall thickness range of the long walls 91 (the Y2 side in the case of the first interengaging portion 95 illustrated in FIG. 5(A)). The abutting faces 95A, i.e., the lower interior wall surfaces of said first interengaging portions 95, are positioned overlappingly in the vertical direction and in a face-to-face relationship with the abutting faces 86A of the second interengaging portions 86 of the top housing half 80 in the array direction of the connecting units 10 (Y-axis direction), and are made capable of abutting said abutting faces 86A (see also FIG. 5(C)). In addition, inclined faces 95B, which are downwardly inclined in the above-mentioned array direction toward the internal side (the Y2 side in the case of the first interengaging portion 95 illustrated in FIG. 5 (A)), are formed in the top portion of said first interengaging portions 95. During connector assembly said inclined faces 95B function as guide faces for guiding the second interengaging portions 86 of the top housing half 90.

As can be seen in FIG. 5(A), the second interengaging portions 96 are formed as recessed portions recessed in the upper faces of said long walls 91 on the external side within the wall thickness range of the long walls 91 (the Y1 side in the case of the second interengaging portion 96 illustrated in FIG. 5(A)). The abutting faces 96A, i.e., the interior wall surfaces of said second interengaging portions 96, are positioned overlappingly in the vertical direction and in a face-to-face relationship with the abutting faces 85A of the first interengaging portions 85 of the top housing half 80 in the above-mentioned array direction (Y-axis direction), and are made capable of abutting said abutting faces 85A (see also FIG. 5(C)).

The engageable portions 93 extend along the exterior surface of the short walls 92 and are coupled to the bottom portions of said short walls 92. Said engageable portions 93, which have two vertical portions 93A extending in the vertical direction and a transverse portion 93B extending in the above-mentioned array direction and linking the upper ends of said two vertical portions 93A, have a generally inverted U-shaped configuration when viewed in the connector width direction (see FIG. 4(B)). In addition, the spaces that are enclosed by the top halves of said vertical portions 93A and the transverse portions 93B and form passages in the connector width direction are formed as engageable recessed portions 93C that permit push-fitting of the hereinafter-described bottom engagement tabs 102 of the coupling members 100.

Figures 4A, 4B:
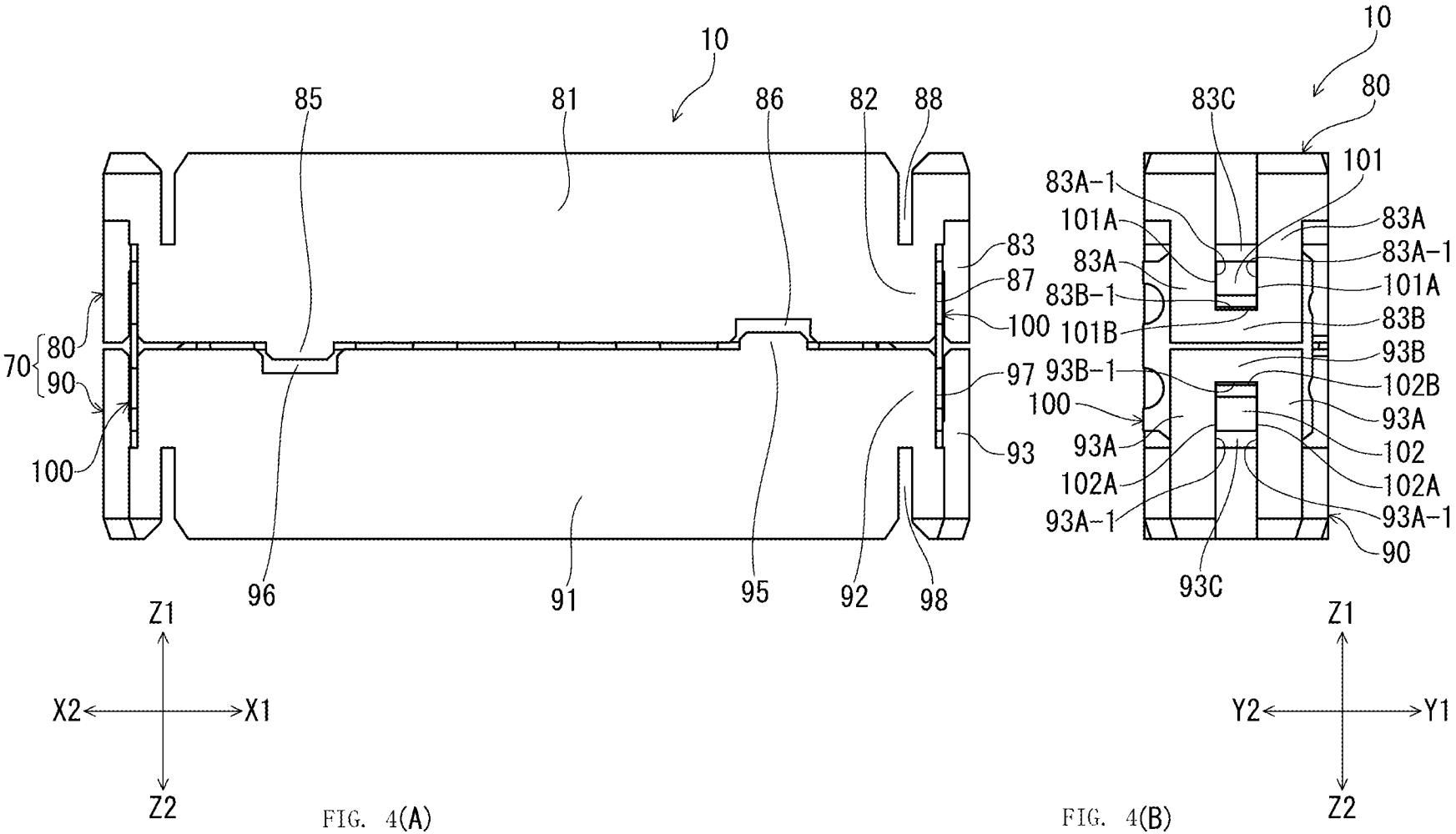
FIG. 4(A) is a front elevation view of a connecting unit provided in the electrical connector of FIG. 1.
FIG. 4(B) is a side view of said connecting unit.

The interior wall surfaces of the engageable recessed portions 93C are formed by the opposed wall surfaces of the two vertical portions 93A (surfaces perpendicular to the above-mentioned array direction (Y-axis direction)) and the bottom face of the transverse portion 93B. As can be seen in FIG. 4(B), the opposed wall surfaces of the above-mentioned vertical portions 93A form engageable faces 93A-1 that can engage the engagement tabs 102 in the above-mentioned array direction, and the bottom faces of the above-mentioned transverse portions 93B form engageable faces 93B-1 that can engage the engagement tabs 102 in the vertical direction.

As can be seen in FIG. 2, FIG. 4(A), and FIGS. 6(A) to 6(C), coupling member holding portions 97, which are slit-shaped insertion grooves extending at right angles to the connector width direction, are formed between the top exterior surfaces of the short walls 92 and the top portions of the engageable portions 93. Along with being upwardly open, said coupling member holding portions 97 form a passage in the above-mentioned array direction that is designed to receive and hold the bottom portion of the coupling members 100 from above (see FIGS. 6(A) to 6(C)).

In addition, as can be seen in FIG. 2, FIG. 4(A), and FIGS. 6(A) to 6(C), end groove portions 98 configured as downwardly open slits are formed in the bottom portion of the short walls 92 of the bottom housing half 90 at locations proximal to both ends in the connector width direction (locations inward of the coupling member holding portions 97). Said end groove portions 98 are designed to receive the top portions of the linking members 130 of the hereinafter-described counterpart connector 3 when the connectors are mated.

The coupling members 100 are made by punching a sheet metal member while maintaining its planar surface and, at the same time, partly bending said sheet metal member. As can be seen in FIG. 2, the coupling members 100 are formed as strip-shaped members extending longitudinally in the array direction of the connecting units 10 (Y-axis direction) and transversely in the vertical direction (Z-axis direction). As can be seen in FIG. 2, along with extending in the above-mentioned array direction across the array range of the connecting units 10, the coupling members 100 also extend in the vertical direction over a range spanning both housing halves 80, 90 and are in a face-to-face relationship with the lateral faces of said connecting units 10 (faces perpendicular to the X-axis direction) (see also FIG. 6(C)). In this manner, the coupling members 100 cover the lateral faces of the connecting units 10, thereby achieving excellent shielding effects. In addition, in the present embodiment, the coupling members 100 are made of plate-shaped members whose major faces are perpendicular to the connector width direction (X-axis direction), and since the dimensions in the connector width direction are substantially equal to the through-thickness dimensions of the coupling members 100, the intermediate connector 1 does not increase in size in the connector width direction.

As can be seen in FIG. 2, at locations corresponding to each connecting unit 10 in the above-mentioned array direction (Y-axis direction), the coupling members 100 have a pair of tabs, i.e., a top engagement tab 101 and a bottom engagement tab 102, which are formed as engaging portions that can engage the engageable portions 83, 93 of the housing halves 80, 90 in the vertical direction and in the above-mentioned array direction. Below, they are collectively referred to as "engagement tabs 101, 102" when there is no need to distinguish them.

Figure 6C:
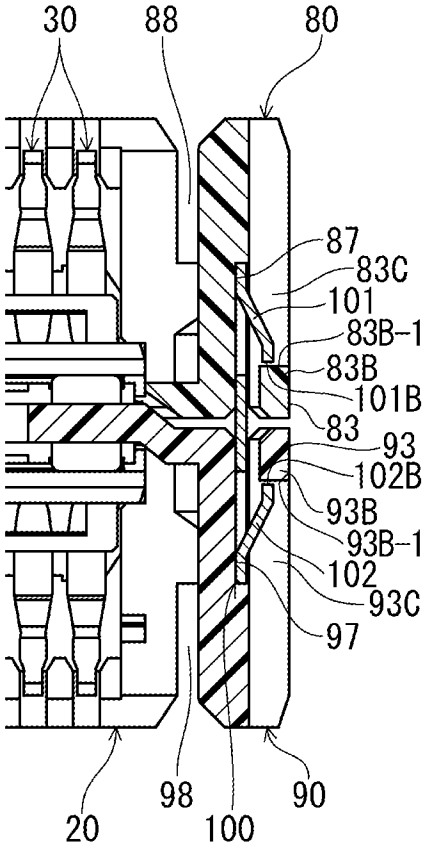
FIGS. 6(A) to 6(C) are views illustrating the steps involved in the fabrication of the electrical connector, in which a portion of the electrical connector is shown in a cross section taken in a plane perpendicular to the direction of coupling.
Figure 6B:
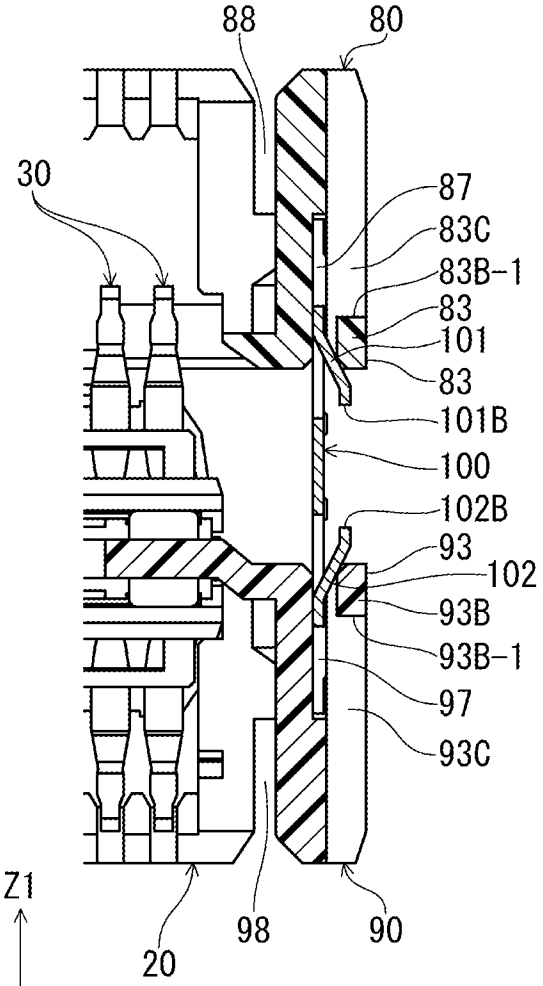
Figure 6A:
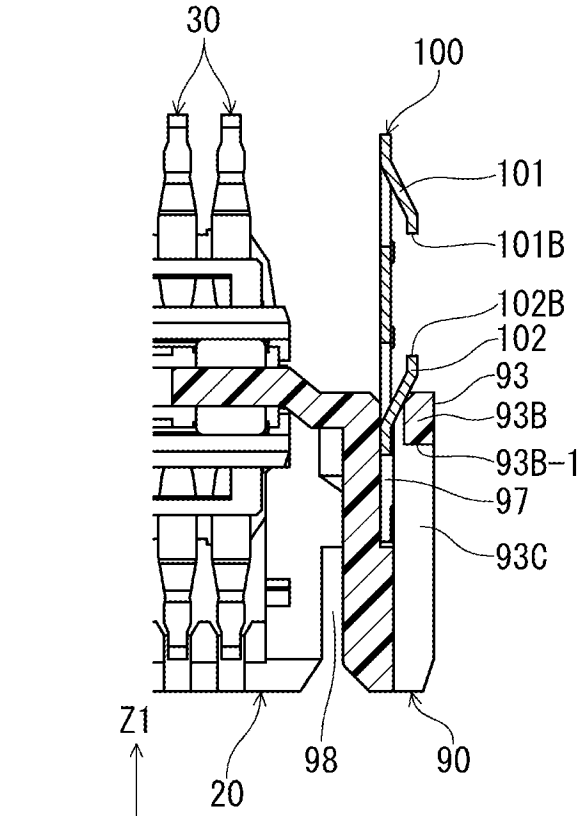

The engagement tabs 101, 102, which are provided at the same locations as the engageable recessed portions 83C, 93C of the housing halves 80, 90 in the above-mentioned array direction, are made by cutting out portions of the coupling members 100 and raising them outwardly in the connector width direction (the Y1 direction for the coupling members 100 illustrated in FIGS. 6(A) to 6(C)). Said engagement tabs 101, 102, which are formed as cantilevered strip-like pieces that extend up and down and are resiliently deformable in the connector width direction, have mutually symmetrical shapes in the vertical direction. Specifically, as can be seen in FIG. 2 and FIGS. 6(A) to 6(C), the top engagement tabs 101 extend outward at an incline in the connector width direction as one moves downwardly from locations on the coupling member 100 that are proximal to the upper end and, at the same time, the distal ends (lower ends) thereof are bent and extend downwardly without being inclined. On the other hand, the bottom engagement tabs 102 extend outward at an incline in the connector width direction as one moves upwardly from locations on the coupling member 100 that are proximal to the lower end and, at the same time, the distal ends (upper ends) thereof are bent and extend upwardly without being inclined.

As can be seen in FIG. 4(B) and FIG. 6(C), the engagement tabs 101, 102 are push-fitted from the inside into the engageable recessed portions 83C, 93C of the respectively corresponding housing halves 80, 90 in the connector width direction, and are disposed inside said engageable recessed portions 83C, 93C.

As can be seen in FIG. 4(B), inside the engageable recessed portion 83C, the lateral end faces located at the edges on both sides of the top engagement tab 101 (faces perpendicular to the Y-axis direction) are in a face-to-face relationship with the engageable faces 83A-1 of the engageable portion 83 and function as engaging faces 101A that can engage said engageable faces 83A-1 in the above-mentioned array direction. In addition, inside the engageable recessed portion 83C, the lower end face located at the lower edge of the top engagement tab 101 (face perpendicular to the Z-axis direction) is in a face-to-face relationship with the engageable face 83B-1 and functions as an engaging face 101B that can engage said engageable face 83B-1 from above.

Therefore, movement of the top housing half 80 in the above-mentioned array direction (Y-axis direction) is restricted as a result of engaging the engaging faces 101A of the top engagement tab 101 and the engageable faces 83A-1 of the top housing half 80, and upward movement of the top housing half 80 (in the Z1 direction) is restricted as a result of engaging the engaging face 101B of the top engagement tab 101 and the engageable face 83B-1 of the top housing half 80.

In addition, inside the engageable recessed portion 93C, the lateral end faces located at the edges on both sides of the bottom engagement tab 102 (faces perpendicular to the Y-axis direction) are in a face-to-face relationship with the engageable faces 93A-1 and function as engaging faces 102A that can engage said engageable faces 93A-1 in the above-mentioned array direction. Furthermore, inside the engageable recessed portion 93C, the upper end face located at the upper edge of the bottom engagement tab 102 (face perpendicular to the Z-axis direction) is in a face-to-face relationship with the engageable face 93B-1 and functions as an engaging face 102B that can engage said engageable face 93B-1 from below.

Therefore, movement of the bottom housing half 90 in the above-mentioned array direction (Y-axis direction) is restricted as a result of engaging the engaging faces 102A of the bottom engagement tab 102 and the engageable faces 93A-1 of the bottom housing half 90, and downward movement of the bottom housing half 90 (in the Z2 direction) is restricted as a result of engaging the engaging face 102B of the bottom engagement tab 102 and the engageable face 93B-1 of the bottom housing half 90.

In the present embodiment, small gaps are formed respectively between the engaging faces 101A and the engageable faces 83A-1, between the engaging face 101B and the engageable face 83B-1, between the engaging face 102A and the engageable face 93A-1, and between the engaging face 102B and the engageable face 93B-1.

Thus, in the present embodiment, movement of the housing halves 80, 90 in the vertical direction and in the above-mentioned array direction can be restricted by the engagement tabs 101, 102 of the coupling members 100. Therefore, it becomes possible to form the connecting units 10 and couple the multiple connecting units 10 using the coupling members 100 alone by bringing said coupling members 100 into engagement with the two housing halves 80, 90. As a result, in contradistinction to conventional coupling connecting units, there is no need to form engagement window portions in the housing halves solely for the purpose of joining the two housing halves. Accordingly, along with improving the strength of the housing halves 80, 90 and simplifying their internal structure, this reduces the number of machine-hours required for the assembly of the intermediate connector 1 and facilitates the operations involved in the assembly of said intermediate connector 1. In addition, in the present embodiment, simply inserting the coupling members 100 into the coupling member holding portions 87, 97 of the housing halves 80, 90 during the assembly process of the intermediate connector 1 allows for the engagement tabs 101, 102 to be push-fitted into the engageable recessed portions 83C, 93C and easily brought into engagement with said engageable recessed portions 83C, 93C.

The intermediate connector 1 according to the present embodiment is manufactured in the following manner. The manufacturing steps required to make the blades 20 will now be described. First, the rows of the multiple terminals 30 provided on a single blade 20 and the substrate 40 are co-molded together by placing the above-mentioned terminal rows into a mold (not shown) in order to form the substrate 40 and then pouring molten plastic into said mold and allowing it to solidify. Next, the blade 20 is completed by ultrasonically welding grounding plates to the substrate 40, i.e., to the two major faces of the substrate 40, by attaching an internal grounding plate 50 to the inner lateral face (major face on the Y2 side in FIG. 3(A) and FIG. 3 (B)) and an external grounding plate 60 to the outer lateral face (major face on the Y1 side in FIG. 3(A) and FIG. 3(B)).

Assembly of the intermediate connector 1 will be described next. First, as can be seen in FIG. 5(A), the bottom housing half 90 is oriented such that the interengaging portions 95, 96 are located at the top. Then, as can be seen in FIG. 5(B), the bottom halves of the blades 20 are introduced into the blade-receiving opening portions 99 of the bottom housing half 90 from above such that the inner lateral faces of the two blades 20 are in mutually opposed relationship. In addition, multiple bottom housing halves 90 (five in the present embodiment) having received therein two blades 20 in this manner are arranged in the thickness direction of said blades 20 (Y-axis direction).

Next, as can be seen in FIG. 6(A), the bottom portions of the coupling members 100 are inserted into the coupling member holding portions 97 of the bottom housing halves 90 from above. At such time, as can be seen in FIG. 6(A), the bottom portions of the coupling members 100 are inserted until the bottom engagement tabs 102 of the coupling members 100 abut the upper ends of the engageable portions 93 of the bottom housing halves 90, and this state is maintained.

Next, as can be seen in FIG. 6(B), the top housing half 80, which is held in an orientation vertically flipped with respect to the bottom housing half 90, is aligned with the corresponding blades 20 from above and the top halves of the blades 20 are introduced into the blade-receiving opening portions 89 of the top housing half 80 (see FIG. 5(C)) from below. In addition, at the same time, the top portions of the coupling members 100 are inserted into the coupling member holding portions 87 of the top housing half 80 from below. At such time, as can be seen in FIG. 6 (B), the top portions of the coupling members 100 are inserted until the top engagement tabs 101 of the coupling members 100 abut the lower ends of the engageable portions 83 of the top housing half 80, and this state is maintained.

Next, the top housing half 80 is press-fitted from above and, at the same time, the bottom housing half 90 is press-fitted from below, thereby mounting the top housing half 80 and the bottom housing half 90 onto the corresponding blades 20. The top portions of the coupling members 100 are inserted into the coupling member holding portions 87 by press-fitting the top housing half 80 from above and, in the process of insertion, the top engagement tabs 101 of the coupling members 100 receive a pushing force exerted inwardly in the connector width direction (Y2 direction in FIG. 6(B)) by the engageable portions 83 of the top housing half 80. As a result, said top engagement tabs 101 undergo resilient deformation in the same direction, thereby permitting further insertion of the coupling members 100. Furthermore, after said top engagement tabs 101 pass the location of the transverse portions 83B of the engageable portions 83 and reach the location of the engageable recessed portions 83C, said top engagement tabs 101 are released from the pushing force exerted by the engageable portion 83 and, as the amount of resilient deformation is decreased, return to a free state in which they are located inside the engageable recessed portions 83C (see FIG. 6(C)).

When the top engagement tabs 101 are located inside the engageable recessed portions 83C, as can be seen in FIG. 4(B), the engaging faces 101A on both sides of the top engagement tab 101 are placed in a face-to-face relationship with the engageable faces 83A-1 of the engageable portion 83 and can engage said engageable faces 83A-1 in the above-mentioned array direction, thereby restricting movement of the top housing half 80 in the above-mentioned array direction. As can be seen in FIG. 4(B) and FIG. 6(C), the engaging faces 101B of the top engagement tab 101 are placed in a face-to-face relationship with the engageable faces 83B-1 of the engageable portion 83 and can engage said engageable faces 83B-1 from above, thereby preventing inadvertent disengagement of the top housing half 80.

In the same manner as discussed above with respect to the top engagement tabs 101, the bottom engagement tabs 102 are introduced into the engageable recessed portions 93C of the bottom housing half 90 by press-fitting the bottom housing half 90 from below, as can be seen FIG. 4(B) and FIG. 6(C). As a result, the engaging faces 102A on both sides of the bottom engagement tabs 102 can engage the engageable faces 93A-1 of the engageable portions 93 in the above-mentioned array direction, thereby restricting movement of bottom housing half 90 in the above-mentioned array direction. In addition, the engaging faces 102B of the bottom engagement tab 102 can engage the engageable faces 93B-1 of the engageable portion 93 from below, thereby preventing inadvertent disengagement of the bottom housing half 90.

In addition, as previously discussed, the first interengaging portions 85 of the top housing half 80 are located in alignment with the second interengaging portions 96 of the bottom housing half 90 and, at the same time, the second interengaging portions 86 of the top housing half 80 are positioned in alignment with the first interengaging portions 95 of the bottom housing half 90. Therefore, once the intermediate connector 1 is completed, the first interengaging portions 85 of the top housing half 80 are push-fitted into the second interengaging portions 96 of the bottom housing half 90 from above and are positioned overlappingly with said second interengaging portions 96 in the vertical direction (see FIG. 4(A) and FIG. 5(C)). In other words, as can be seen FIG. 5(C), the abutting faces 85A of the above-mentioned first interengaging portions 85 and the abutting faces 96A of the above-mentioned second interengaging portions 96 are in a face-to-face relationship and can abut one another in the above-mentioned array direction (Y-axis direction). Furthermore, the first interengaging portions 95 of the bottom housing half 90 are push-fitted into the second interengaging portions 86 of the top housing half 80 from below and are positioned overlappingly with second interengaging portions 86 in the vertical direction. In other words, as can be seen FIG. 5(C), the abutting faces 95A of the above-mentioned first interengaging portions 95 and the abutting faces 86A of the above-mentioned the second interengaging portions 86 are in a face-to-face relationship and can abut one another in the above-mentioned array direction.

In the present embodiment, as previously discussed, when the respective housing halves 80, 90 are viewed in the vertical direction, the first interengaging portions and second interengaging portions are all located such that they are point symmetric relative to the center of the housing halves 80, 90. In other words, as far as the top housing half 80 and bottom housing half 90 are concerned, even if one housing half is rotated 180° about a vertically extending axis with respect to the other housing half, when the intermediate connector 1 is completed, the first interengaging portions and second interengaging portions will be positioned in alignment. Therefore, when the intermediate connector 1 is assembled, the two housing halves can be combined even in an inverted position obtained by rotating 180° about an axis extending in the vertical direction (Z-axis direction) relative to each other. In addition, since the top housing half 80 and bottom housing half 90 are made with the same shape, both housing halves, i.e., the top housing half 80 and bottom housing half 90, can be fabricated with the same kind of mold. As a result, the intermediate connector 1 can be manufactured inexpensively and easily.

The configuration of the counterpart connectors 2 and 3 will be described next. As can be seen in FIG. 1, in the present embodiment, the counterpart connectors 2 and 3, whose number is equal to that of the connecting units 10, are arranged at equally spaced intervals in the same direction as the array direction of said connecting units 10 (Y-axis direction), and all the counterpart connectors 2 and 3 are linked by the hereinafter-described linking members 130. Since the counterpart connectors 2 and 3 have exactly the same configuration, the description below will focus on the configuration of the counterpart connectors 3. The counterpart connectors 2 will be assigned the same reference numerals as the counterpart connectors 3 and their description will be omitted.

As can be seen in FIG. 1, the counterpart connectors 3 have: a housing 110 made of electrically insulating material extending longitudinally in the connector width direction (X-axis direction), multiple terminals 120 (referred to as "counterpart terminals 120" below) held in array form in the connector width direction by said housing 110, and counterpart grounding plates (not shown) held in the housing 110.

As can be seen in FIG. 1, the housing 110, which extends longitudinally in the connector width direction, is formed to have substantially the same dimensions as the intermediate connector 1 in the same direction. Said housing 110 has multiple terminal holding portions 111 arranged in the connector width direction at equally spaced intervals on the two wall surfaces extending in the connector width direction (faces perpendicular to the Y-axis direction). Said terminal holding portions 111, which have a groove-shaped configuration that is obtained by indenting the above-mentioned wall surfaces and extends in the vertical direction, are designed to receive and hold the counterpart terminals 120.

The housing 110 has a counterpart grounding plate of sheet metal (not shown) embedded and secured in place at a central location in its thickness direction (Y-axis direction). Said counterpart grounding plate, which has major faces perpendicular to the above-mentioned thickness direction, extends across nearly the entire length of the counterpart connector 3 in the connector width direction.

As can be seen in FIG. 1, the counterpart terminals 120, which are made by punching a sheet metal member in the through-thickness direction and have a general strip-like shape extending in the vertical direction, are press-fitted and secured in place in the terminal holding portions 111 of the housing 110 from below and are arranged in the connector width direction. Said counterpart terminals 120 have contact portions on the upper end side that are intended for contact with the bottom contact portions 32A of the terminals 30 of the intermediate connector 1 as well as connecting portions on the lower end side that are intended for solder connection to the corresponding circuitry on a circuit board (not shown). Said connecting portions protrude from the bottom face of the housing 110. FIG. 1 shows solder balls B attached to said connecting portions.

The linking members 130 have major faces perpendicular to the connector width direction (X-axis direction) and extend across the entire array range of the counterpart connectors 3 in the array direction of the counterpart connectors 3 (Y-axis direction). Said linking members 130 are located such that their major faces are in a closely spaced face-to-face relationship with the faces on both sides of the counterpart connectors 3 in the connector width direction (faces perpendicular to the X-axis direction) while the top edges of said linking members 130 are coupled to a grounding plate (not shown).

The operation of connector mating between the intermediate connector 1 and the counterpart connectors 2 and 3 will be described next. First, multiple (five in the present embodiment) counterpart connectors 2 and 3 are solder-attached to different circuit boards (not shown). Next, the counterpart connectors 3 are held in an orientation in which the contact portions of the counterpart terminals 120 are located at the top (orientation illustrated in FIG. 1) and said intermediate connector 1 is positioned above the counterpart connectors 3 such that the bottom receiving portion 12 of each connecting unit 10 of the intermediate connector 1 (see FIG. 5(C)) is aligned with the respectively corresponding counterpart connector 3.

Next, the intermediate connector 1 is lowered (see arrow in FIG. 1) and each connecting unit 10 is fitted into the respectively corresponding counterpart connector 3 from above. When the mating of the intermediate connector 1 with the counterpart connectors 3 is complete, the bottom contact portions 32A of the terminals 30 provided on the blades 20 of the connecting units 10 are brought into contact under contact pressure and placed in electrical communication with the contact portions of the counterpart terminals 120 provided on the counterpart connectors 3. At such time, under the action of the pushing force exerted by the contact portions of the counterpart terminals 120, the bottom contact portions 32A are resiliently displaced in the array direction of the connecting units 10 (Y-axis direction) toward the long walls 91 of the bottom housing half 90. As a result of resiliently displacing said bottom contact portion 32A, the substrates 40 of the blades 20 holding the terminals 30 abut the interior wall surface of the long walls 91. Consequently, the long walls 91 receive the force exerted by the substrates 40 and the abutting faces 96A of the second interengaging portions 96 of the bottom housing half 90 abut the abutting faces 85A of the first interengaging portions 86 of the top housing half 80 in the above-mentioned array direction. As a result, the force exerted by the counterpart connectors 3 is received by both housing halves 80, 90, in other words, by the entire housing 70.

Next, the counterpart connectors 2, which are held in an orientation flipped with respect to the counterpart connectors 3 (in the orientation illustrated in FIG. 1), are matingly connected to the intermediate connector 1 from above (see arrow in FIG. 1). The procedure for the mating connection of said counterpart connectors 2 is identical to the previously discussed procedure used for the counterpart connectors 3. At such time, under the action of the pushing force exerted by the contact portions of the counterpart terminals 120, the top contact portions 31A of the terminals 30 are resiliently displaced in the above-mentioned array direction (Y-axis direction) toward the long walls 81 of the top housing half 80. As a result of resiliently displacing said top contact portion 31A, the substrates 40 of the blades 20 holding the terminals 30 abut the interior wall surface of the long walls 81. Consequently, the long walls 81 receive the force exerted by the substrates 40 and the abutting faces 86A of the second interengaging portions 96 of the top housing half 80 abut the abutting faces 95A of the first interengaging portions 95 of the bottom housing half 90 in the above-mentioned array direction. As a result, the force exerted by the counterpart connectors 2 is received by both housing halves 80, 90, in other words, by the entire housing 70.

In this manner, as a result of matingly connecting the counterpart connectors 2 and counterpart connectors 3 to the intermediate connector 1, the respectively corresponding counterpart connectors 2 and counterpart connectors 3 are electrically connected via the connecting units 10.

In accordance with the present embodiment, even though the housing 70 is made up of the two housing halves 80, 90, the forces exerted by the counterpart connectors 2 and 3 in the mated state can be received by the housing 70 as a whole and, therefore, sufficient resistance to the forces exerted by the counterpart connectors 2 and 3 can be achieved even without increasing the size of the housing 70 in order to make said housing 70 stronger.

The shapes of the respective interengaging portions of the housing halves are not limited to the shapes illustrated in FIG. 5(C) and permit various modifications. For example, if the interengaging portions are formed in the opposed sections of the two housing halves, for example, in the opposed sections of the long walls, a configuration may be used in which protrusions projecting from opposed surfaces of the long walls of the housing halves, or the opposed sections of the long walls, are used as the first interengaging portions, and opening portions made in the opposed surfaces of the long walls of the housing halves are used as the second interengaging portions, with all of the above-mentioned first interengaging portions push-fitted into the above-mentioned second interengaging portions.

Although in the present embodiment a single interengaging portion is provided on the respective long walls of the housing halves 80, 90 at each location proximal to the ends in the connector width direction, the number and position of the provided interengaging portions are not limited thereto. For example, a single interengaging portion extending in the connector width direction throughout substantially the entire length of the long walls may be provided in each respective long wall and, in addition, multiple interengaging portions may also be provided within the above-mentioned range at predetermined spaced intervals.

Although in the present embodiment, in the step where, during connector assembly, the engagement tabs 101, 102 of the coupling members 100 are respectively press-fitted into the coupling member holding portions 87, 97 of the housing halves 80, 90 (press-fitting step), it's only the engaging portions, i.e., the engagement tabs 101, 102, that undergo resilient deformation while the engageable portions of the housing halves do not undergo resilient deformation. As an alternative example, the thickness dimension of the engageable portions of the housing halves (dimensions in the X-axis direction) may be reduced such that it is not only the engagement tabs of the coupling members, but also the engageable portions of the housing halves that undergo resilient deformation. In addition, as a further alternative example, it may be possible to allow only the engageable portions of the housing halves to be deformed in the above-mentioned press-fitting step. Namely, the engaging portions of the coupling members may be formed using shapes unsusceptible to resilient deformation, such as prongs and the like protruding from the major faces of the coupling members, and, at the same time, the thickness dimension of the engageable portions of the housing halves may be reduced so as to permit only the above-mentioned engageable portions to undergo resilient deformation in the above-mentioned press-fitting step.

DESCRIPTION OF THE REFERENCE NUMERALS

1 Intermediate connector (electrical connector)
2 Counterpart connector (counterpart connector component)
3 Counterpart connector (counterpart connector component)
10 Connecting unit
20 Blade
30 Terminal
70 Housing
80 Top housing half
83 Engageable portion
83C Engageable recessed portion
85 First interengaging portion
85A Abutting face (wall surface)
86 Second interengaging portion
86A Abutting face (wall surface)
90 Bottom housing half
91 Engageable portion
93C Engageable recessed portion
95 First interengaging portion
95A Abutting face (wall surface)
96 Second interengaging portion
96A Abutting face (wall surface)
97 Coupling member holding portion (insertion groove)
100 Coupling member
101 Top engagement tab (engaging portion)
101A Engaging face (edge)
101B Engaging face (edge)
102 Bottom engagement tab (engaging portion)
102A Engaging face (edge)
102B Engaging face (edge)

What is claimed is:

1. An electrical connector configured such that blades that hold in place arrays of multiple terminals extending in a direction of connection to counterpart connector components are secured in place by a pair of housing halves split in said direction of connection, thereby forming a single connecting unit, each of the respective paired housing halves configured to be mated with a corresponding one of the counterpart connector components in the direction of connection, and multiple connecting units are coupled by coupling members extending in a coupling direction perpendicular to the terminal array plane of the blades, wherein:

the coupling members are positioned so as to span both paired housing halves and extend across multiple connecting units in the coupling direction, while, at the same time, having pairs of engagement tabs engaging the respective housing halves of each connecting unit, wherein each of the pairs of engagement tabs comprises a top engagement tab extending outward at a down rd incline in a connector width direction and having a lower distal end bent and extending downwardly at a direction different from the downward incline forming an engaging face, and a bottom engagement tab extending outward at an upward incline in the connector width direction and having an upper distal end bent and extending upwardly at a direction different from the upward incline forming another engaging face, and each of the paired housing halves have recesses engaging the corresponding engagement tabs both in the direction of connection and in the coupling direction.

2. The electrical connector according to claim 1, wherein the coupling members are metal strip-shaped members and the engagement tabs are obtained by cutting out and raising portions of said coupling members and are resiliently deformed.

3. The electrical connector according to claim 2, wherein the recesses are configured to have the engagement tabs to be push-fitted therein, and the engagement tabs are adapted to engage the interior wall surfaces of the recesses of the housing halves with the edges of said engagement tabs.

4. The electrical connector according to claim 3 wherein, in the housing halves, there are formed insertion grooves that are open to the mutually opposed surfaces of the paired housing halves forming the connecting units and that permit insertion of the coupling members in the direction of connection up to the central location of said coupling members, and, in the coupling members, the engagement tabs can undergo resilient deformation when said coupling members are inserted into the insertion grooves, and, once a predetermined position is reached, the amount of resilient deformation is reduced and the tabs are push-fitted into the recesses of the housing halves.

* * * * *